US008002040B2

(12) United States Patent
May et al.

(10) Patent No.: US 8,002,040 B2
(45) Date of Patent: Aug. 23, 2011

(54) SYSTEM AND METHOD FOR CONTROLLING FLOW IN A WELLBORE

(75) Inventors: Dwayne May, Humble, TX (US); David McCalvin, Missouri City, TX (US); Paul Gordon Goughnour, Fresno, TX (US); David James Biddick, Missouri City, TX (US); Russell Alan Johnston, Alvin, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/108,151

(22) Filed: Apr. 23, 2008

(65) Prior Publication Data

US 2009/0266555 A1 Oct. 29, 2009

(51) Int. Cl.
*E21B 34/00* (2006.01)
*G05D 7/01* (2006.01)

(52) U.S. Cl. ..... 166/332.8; 137/513.3; 138/45; 251/212

(58) Field of Classification Search ..... 166/332.8; 137/513.3; 251/212; 138/45, 46
See application file for complete search history.

(56) References Cited

U.S. PATENT DOCUMENTS

| | | | | | |
|---|---|---|---|---|---|
| 2,798,561 | A * | 7/1957 | True | ..... | 166/321 |
| 3,481,397 | A * | 12/1969 | Baker | ..... | 166/320 |
| 3,724,493 | A | 4/1973 | Kisling | | |
| 3,799,192 | A | 3/1974 | Young | | |
| 3,814,181 | A | 6/1974 | Young | | |
| 3,848,629 | A | 11/1974 | Young | | |
| 3,965,926 | A * | 6/1976 | Buckner | ..... | 137/512.1 |
| 3,978,922 | A | 9/1976 | Johnson | | |
| 4,216,830 | A | 8/1980 | Fredd | | |
| 4,415,038 | A * | 11/1983 | Schmuck | ..... | 166/373 |
| 4,474,241 | A * | 10/1984 | Freeman | ..... | 166/317 |
| 4,597,449 | A | 7/1986 | Keeney | | |
| 4,825,902 | A * | 5/1989 | Helms | ..... | 137/515 |
| 5,988,285 | A | 11/1999 | Tucker | | |
| 6,296,061 | B1 * | 10/2001 | Leismer | ..... | 166/386 |
| 2002/0033262 | A1 * | 3/2002 | Musselwhite et al. | ..... | 166/285 |
| 2006/0162932 | A1 | 7/2006 | McCalvin | | |
| 2006/0162939 | A1 * | 7/2006 | Vick et al. | ..... | 166/386 |
| 2007/0284118 | A1 | 12/2007 | Benton | | |
| 2008/0179051 | A1 * | 7/2008 | Willis et al. | ..... | 165/173 |

* cited by examiner

*Primary Examiner* — David J Bagnell
*Assistant Examiner* — Catherine Loikith
(74) *Attorney, Agent, or Firm* — Brandon S. Clark; Rodney Warfford

(57) ABSTRACT

A technique enables control over flow in a wellbore with a flow control system. The flow control system combines a flow reduction mechanism with a flow control device, such as a valve. The flow reduction mechanism comprises a closure member which can be selectively moved between an unactuated and actuated position, allowing relatively greater flow through the flow control device in the unactuated position. The flow reduction mechanism actuates prior to or in conjunction with the flow control device to reduce flow and thus reduce the loading forces that would otherwise act against the flow control mechanism upon closure of the flow control device.

16 Claims, 7 Drawing Sheets

SYSTEM AND METHOD FOR CONTROLLING FLOW IN A WELLBORE

BACKGROUND

In many well related operations, appropriate well equipment is moved downhole to control fluid flow. For example, various completions are used to facilitate and control the flow of fluid in both production operations and injection operations. Valves are sometimes used to choke or otherwise control flow of fluid through the well equipment.

In some applications, detrimental reverse flow can be a problem and valves have been used to prevent flow in the undesirable direction. Flapper valves, for example, have been used to enable flow through tubing in one direction while blocking flow in the opposite direction. However, flapper valves offer limited ability for adjustment to accommodate various procedures during a production and/or injection operation.

For example, many subsurface safety valves utilize a flapper as a closure mechanism fitted within a body or housing member to enable control over fluid flow through a primary longitudinal bore upon an appropriate signal from a control system. The signal typically is a rapid reduction of the hydraulic operating pressure that holds the valve open, thereby facilitating shut-in of the production or injection flow. The closure mechanism typically is movable between the full closed and full open positions by movement of a tubular device, often called a flow tube. The flow tube can be moved to the open position or operated by the valve actuator which is motivated by hydraulics, pressure, electronics, or other external signal and power sources. The shifting of the flow tube to a closed position typically is performed by a mechanical power spring and/or a pressurized accumulator that applies a required load to move the flow tube to the closed position upon interruption of the "opening" signal. As a result, the valve may occasionally be required to close against a moving flow stream in the performance of its designed function. However, this action can subject the valve to substantial loading forces.

SUMMARY

In general, the present invention provides a system and method for controlling flow in a wellbore. A flow control system combines a flow reduction mechanism with a flow control device, such as a valve. The flow reduction mechanism comprises a closure member, such as a flapper type device having one or more flapper elements pivotally mounted in the flow reduction mechanism. The flow reduction mechanism actuates prior to or in conjunction with the flow control device to reduce flow and thus reduce the loading forces that would otherwise act against the flow control device upon closure of the flow control device.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
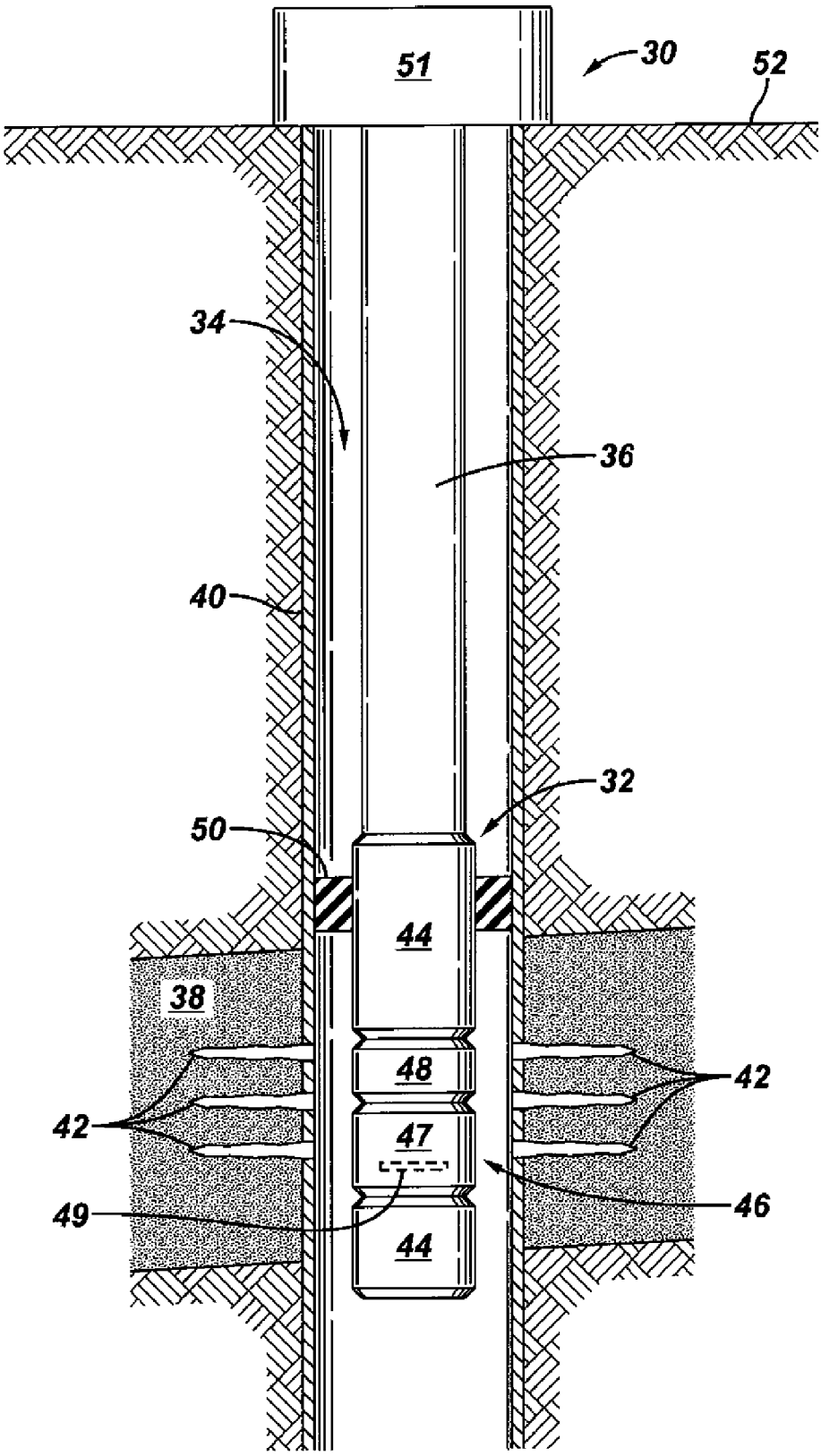
FIG. 1 is a front elevation view of a well assembly having a flow control system deployed in a wellbore, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a flow control system used to control flow in a wellbore. For example, the flow control system comprises a flow control device combined with a flow reduction mechanism for use in a variety of well related operations. The flow control system can be used in production and/or injection operations.

Generally, combining the flow restricting or flow reduction mechanism with the flow control device reduces potential loads acting on the flow control device which enhances the ability of the flow control device to close and seal effectively. In production applications, this allows higher production rates without adverse impact on the reliability of the flow control device. In many applications, the flow reduction mechanism is designed to actuate prior to closure of the flow control device to reduce flow through the closure device. The flow reduction mechanism can actuate separately or in concert with the flow control device. In some embodiments, the flow reduction mechanism can be disposed in a body of the flow control device and also utilize certain common actuation components.

The flow reduction mechanism reduces the flow rate through the flow control device, e.g. valve, which thereby reduces the loading forces applied to the actuation mechanism components during performance of a primary function of the flow control device, i.e. shutting off flow during an uncontrolled flow event. In a producing well, for example, the production flow is shut off during an uncontrolled event. The flow reduction device does not normally affect the nominal flow area of the flow control device, which allows the nominal flow area to remain unobstructed during normal flow periods although in some situations the nominal flow area may be slightly reduced. However, the ability to reduce flow enables higher initial flow rates through the flow control device because the closure rate and flow induced loadings are reduced by the flow reduction mechanism prior to exposing the flow control device to full dynamic closure loading.

As a result, the flow reduction device is useful in conjunction with a variety of flow control devices, including subsurface safety valves and other valves used in oil or gas production and injection well completions, to prevent uncontrolled well flows for example. The flow reduction method and system also enables higher flow rates and provides protection in wells having flow rates that can be potentially damaging to flow control devices during emergency closures, or slam closures for example. Use of the flow reduction device within the flow control system results in a reduction of the flow related loading caused by the rapid closures of the primary valve system, thereby allowing the application of valve systems of high durability within dimensional and flow rate limits that are otherwise impractical. The flow reduction device can be used as part of or in cooperation with many types of flow control devices having flapper mechanisms and other types of closure mechanisms. Additionally, the flow reduction device may be mounted with a variety of methods such as casing mounted, tubing mounted, or wireline mounted for example. However, the flow reduction device is not to be limited for use with safety valves or to prevent uncontrolled well flows, any application requiring a reduced flow rate in either direction though a well bore may incorporate a flow reduction device.

Referring generally to FIG. 1, one embodiment of a well system is illustrated as utilizing a flow control system that comprises a flow reduction mechanism to reduce loading on the corresponding flow control device. In this embodiment, a well system 30 comprises a well equipment string, such as a completion string 32, deployed in a wellbore 34 via a conveyance 36. The wellbore 34 is drilled into a subsurface formation 38 that may contain desirable production fluids, such as petroleum. In the example illustrated, wellbore 34 is lined with a casing 40. The casing 40 typically is perforated to form a plurality of perforations 42 through which fluid can flow from formation 38 into wellbore 34 during production or from wellbore 34 into formation 38 during an injection operation.

In the embodiment illustrated, completion 32 and conveyance 36 comprise an internal fluid flow passage along which fluid potentially can flow downhole and/or uphole, depending and the operation being conducted. In most applications, completion 32 is formed as a tubular and may comprise a variety of components 44 depending on the specific operation or operations that will be performed in wellbore 34. A flow control system 46 is positioned to enable control over flow through completion 32 or along other fluid flow paths routed through a variety of wellbore tubulars or other fluid conducting components. In the embodiment illustrated, flow control system 46 may be coupled to components 44 of completion 32. Additionally, flow control system 46 comprises a primary flow control device 47, such as a valve, and a flow reduction mechanism 48. Flow control device 47 may comprise a subsurface safety valve or a variety of other valves or flow control devices. Generally, flow control device 47 comprises a barrier mechanism 49, such as a flapper, that can be used to shut off flow through completion 32. Barrier mechanism 49, however, also may comprise ball valves and other types of barrier devices that can move between open and closed positions. Completion 32 also may utilize one or more packers 50 positioned and operated to selectively seal off one or more well zones along wellbore 34 to facilitate production and/or injection operations.

Flow reduction mechanism 48 provides flow control device 47, e.g. a subsurface safety valve or other downhole flow controlling device, with the capability of actuation against production flow rates where proper actuation would otherwise be unattainable. The flow reduction mechanism is positioned in the flow path (or area of flow) through flow control device 47 and is selectively actuatable to reduce flow through device 47 to a portion of its full flow capacity. Actuation of the flow reduction mechanism 48 may be separate or in conjunction with actuation of flow control device 47 and may include, but not be limited by, one of the following methods: mechanical, hydraulic, electrical, magnetic, electronic, pressure, thermal, and chemical, among others. Flow reduction mechanism 48 also can be utilized with other downhole valves and devices that benefit from restricting flow through the device prior to activation of the device closure system.

As illustrated, wellbore 34 is a generally vertical wellbore extending downwardly from a wellhead 51 disposed at a surface location 52. However, flow control system 30 can be utilized in a variety of vertical and deviated, e.g. horizontal, wellbores to control flow along tubulars positioned in those wellbores. Additionally, the wellbore 34 can be drilled in a variety of environments, including subsea environments. Regardless of the environment, flow control system 46 is used to provide greater control over flow and to enable fail safe operation.

Figure 2:
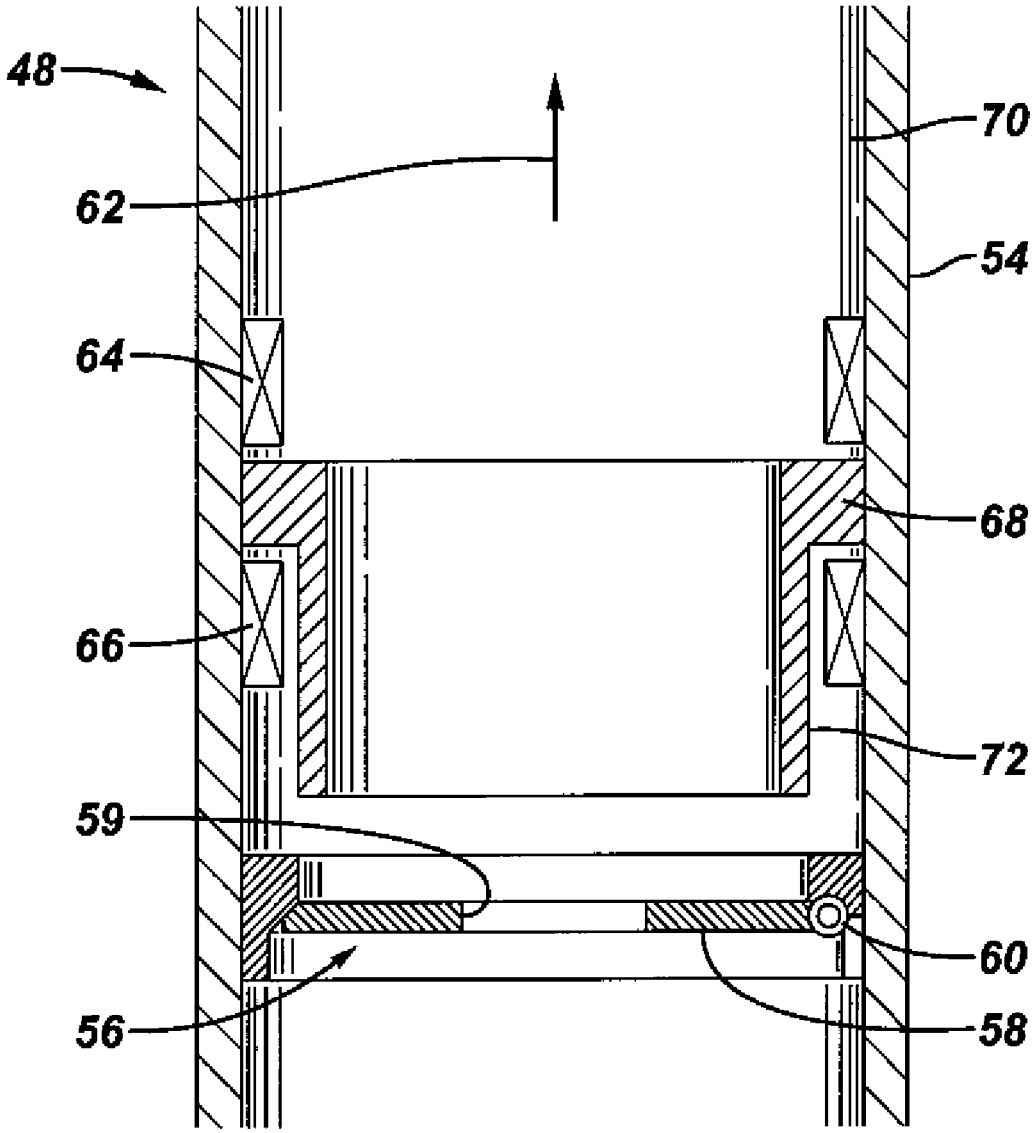
FIG. 2 is a schematic illustration of a flow reduction mechanism used with the flow control system of FIG. I, according to an embodiment of the present invention.

Referring generally to FIG. 2, one example of flow reduction mechanism 48 is illustrated schematically as deployed in a tubular structure 54 that may be part of completion 32. Tubular structure 54 also may be the longitudinal region of the flow area of flow control device 47 (see FIG. 1). In this embodiment, flow reduction mechanism 48 comprises a flow restriction assembly 56 that may include a variety of flow reducing members, such as a flapper assembly having one or more flapper elements 58. In other embodiments, however, flow restriction assembly 56 may comprise collets, slidable segmented plates, or other devices that are readily movable between open and closed positions. By way of further example, flapper element 58 may comprise a single flapper element with an opening 59. In other embodiments, opening 59 may be formed by a plurality of flapper elements 58 that close in a manner that forms opening 59 to restrict flow while allowing a desired amount of flow.

In the embodiment illustrated, flapper element 58 is pivotally mounted in flow reduction mechanism 48 via a pivot connection 60. When flow reduction mechanism 48 is positioned as illustrated, flapper element 58 restricts flow moving along a flow path 62. In one example, flapper element 58 can be designed to pivot to an open position under the influence of fluid flowing in a downhole direction. However, when flow moves in an opposite, e.g. uphole, direction flapper element 58 is automatically pivoted to a flow restricting position.

Flow reduction mechanism 48 further comprises an actuation assembly 64, a stored energy assembly 66, and an isolation assembly 68. The actuation assembly 64 is designed to force the flow reduction mechanism 48 to a position in which flapper element or elements 58 are held in an open position when provided with an appropriate signal/input. The signal may be provided via, for example, a control line 70 that extends to a surface location. The stored energy assembly 66 acts against the actuation assembly 64 to bias the flow reduction mechanism 48 toward a configuration in which flapper elements 58 can pivot to a closed position. Actuation assembly 64 is selectively operable to shift flow reduction mechanism 48 from this latter configuration by moving an isolation assembly 68 to a position that holds mechanism 48 in an open flow configuration. For example, actuation assembly 64 can be operated to move isolation assembly 68 in a manner that forces flapper element 58 to an open position. When the input to actuation assembly 64 is changed, stored energy assembly 66 is able to return isolation assembly 68 to its initial position, thus allowing free operation of valve assembly 56, e.g. free pivoting motion of flapper element 58 to the closed position.

The components of flow reduction mechanism 48 can be designed in a variety of configurations. For example, actuation assembly 64 may comprise a hydraulic piston, an electromechanical device, a gas-piston coupled with a hydraulic system, or other devices that may be selectively actuated to move isolation assembly 68. The actuation assembly 64 also can be designed to operate under the influence of flow directed downhole. Depending on the design of actuation assembly 64, control line 70 may comprise a hydraulic control line, an electric control line, an optical control line, a wireless signal receiver, or other suitable devices for providing the appropriate signal to actuation assembly 64. Additionally, stored energy assembly 66 may comprise a variety of devices, such as one or more springs. By way of example, stored energy assembly 66 may comprise one or more coil springs, gas springs, wave springs, power springs or other suitable springs able to store energy upon movement of isolation assembly 68 via actuation assembly 64. Depending on the requirements of a given application, the orientation of the stored energy assembly 66 can be selected to hold the device in a normally closed or normally open position. In alternative embodiments, stored energy assembly 66 could be replaced with a second control line, e.g. a second hydraulic line, to cause movement of isolation assembly 68 back to its previous position.

The isolation assembly 68 is designed to cooperate with flow restriction assembly 56 in a manner that enables selective shifting of the restriction assembly 56 to an open position. For example, when flow restriction assembly 56 comprises flapper element 58, isolation assembly 68 can comprise a tubular member 72 positioned to move into flapper element 58 and to pivot flapper element 58 to an open position. In some applications, tubular member 72 is the same flow tube used to actuate the primary flow control device 47 (see FIG. 1) from one operational position to another. It should be noted that isolation assembly 68 can be designed in a variety of configurations. In an alternate embodiment, the illustrated isolation assembly can even be replaced with levers or other mechanisms able to open and close the flappers 58 or other closure elements. In still other embodiments, isolation assembly 68 can be actuated by fluid velocity.

In fact, flow control device 47 (see FIG. 1) and flow reduction mechanism 48 can be designed and positioned in a variety of cooperative configurations. For example, flow control device 47 may comprise a valve, e.g. a subsurface safety valve, having a variety of primary motivators or operators that can be positioned to actuate both the valve and the flow reduction mechanism 48. For example, tubular member 72 may be formed as part of the primary motivator for actuating the valve-type flow control device 47. In other embodiments, alternate mechanisms can be used to actuate the flow reduction mechanism 48 and the flow control device 47. The use of alternate mechanisms facilitates positioning of the flow reduction mechanism 48 and flow control device 47 in adjacent housings or in separate subs. Regardless, the flow reduction mechanism 48 is designed to selectively reduce the available flow rate which, in turn, reduces impact loading during slam closures of the primary sealing mechanism, e.g. flapper element 49, of the flow control device 47.

Figure 3:
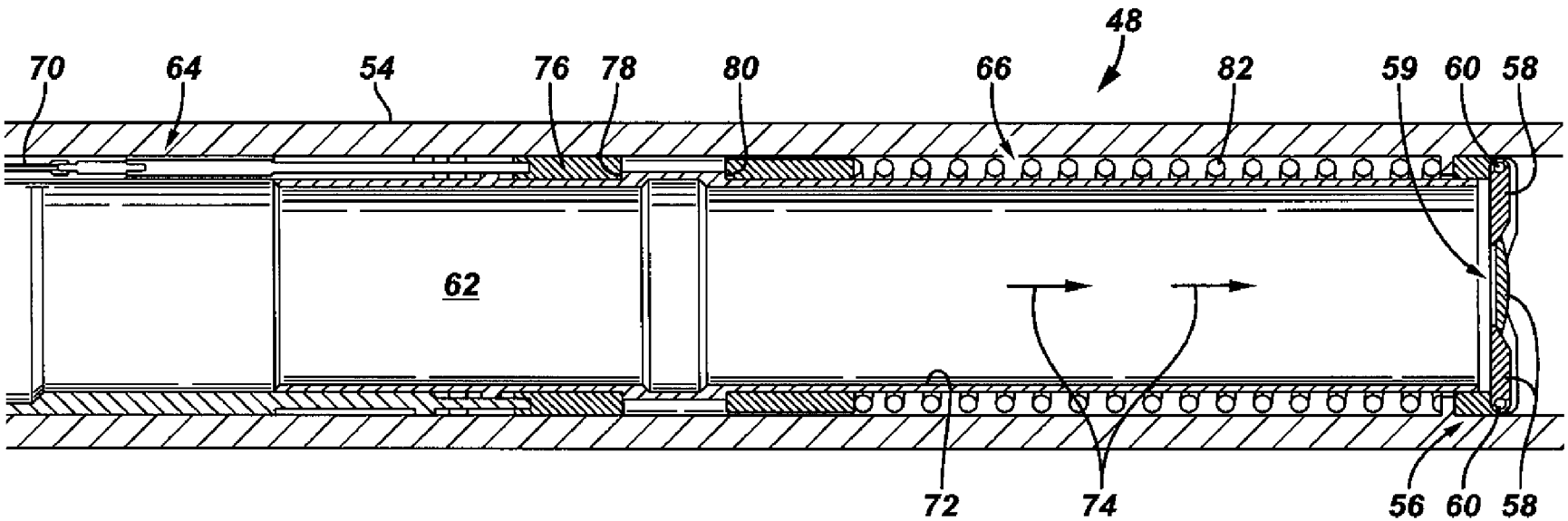
FIG. 3 is a cross-sectional view taken generally along the axis of one example of the flow reduction mechanism illustrated in FIG. 2, according to an embodiment of the present invention.
Figure 4:
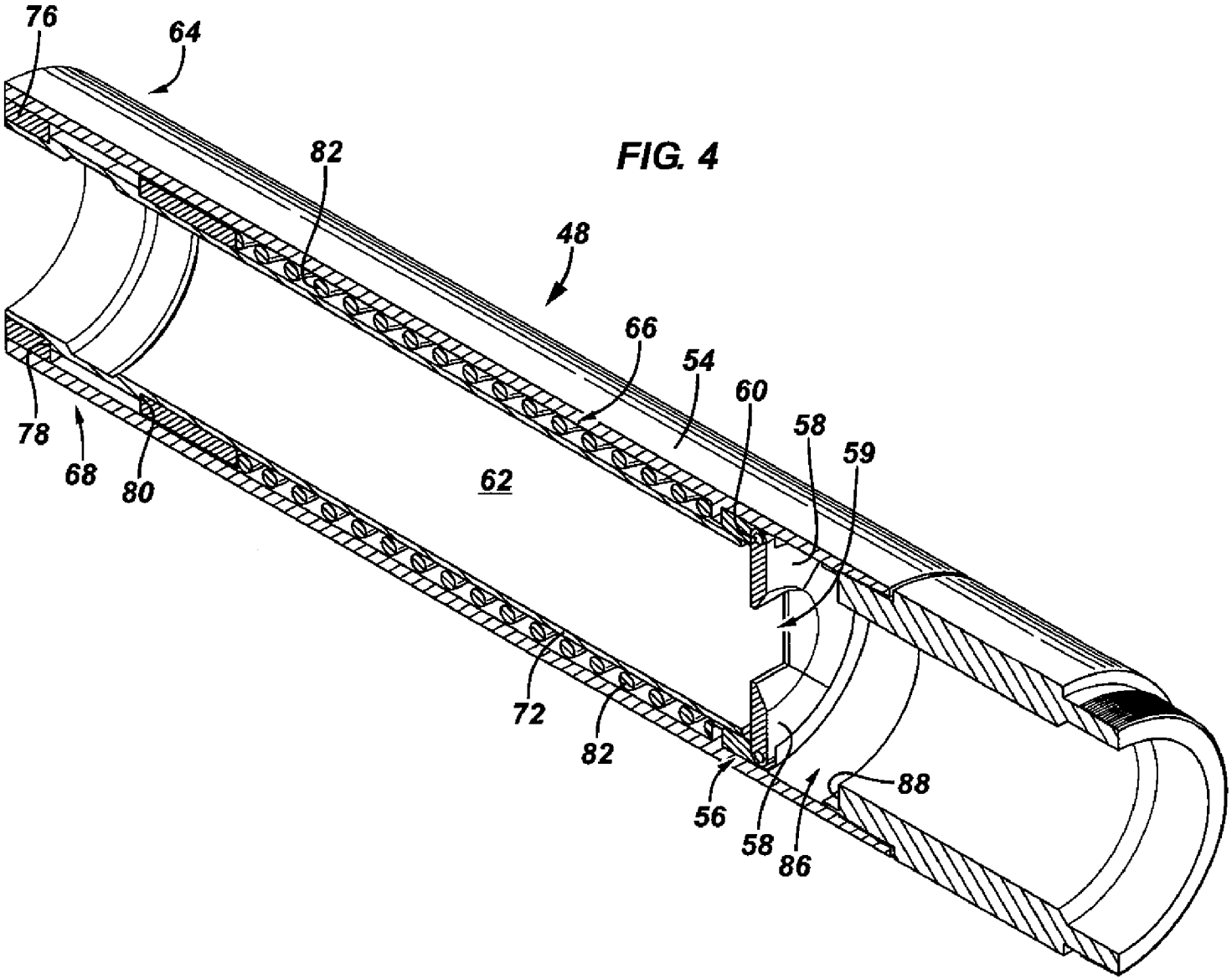
FIG. 4 is another cross-sectional view taken generally along the axis of the flow reduction mechanism while in a closed configuration, according to another embodiment of the present invention.
Figure 5:
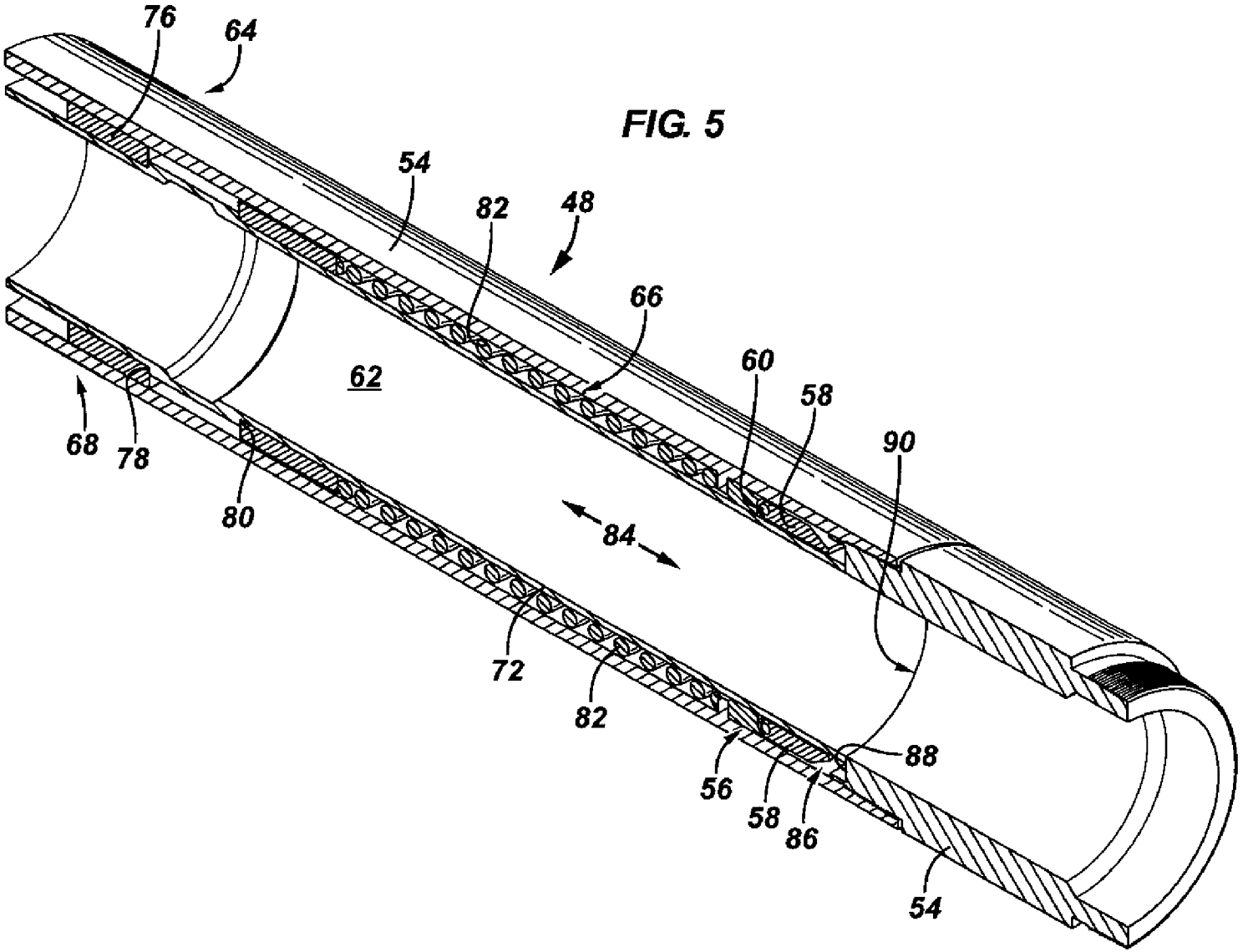
FIG. 5 is a cross-sectional view similar to that of FIG. 4, but showing the flow reduction mechanism shifted to an enclosed, open configuration, according to an embodiment of the present invention.

A specific example of a flow reduction mechanism 48 is illustrated in FIGS. 3-5. In this embodiment, flow reduction mechanism 48 comprises flapper element 58 and specifically a plurality of flapper elements 58 that form opening 59 when closed. The flapper elements 58 are pivotally mounted to enable full bore flow of fluid, illustrated by arrows 74, when the flow control device is in the position illustrated in FIG. 3. When fluid is flowed through flow restriction assembly 56 in the direction of arrows 74, flapper elements 58 can freely pivot to an open position to enable flow along the fluid flow path 62. However, fluid flow in an opposite, e.g. uphole, direction is reduced/restricted to facilitate actuation of flow control device 47 (see FIG. 1).

In this embodiment, actuation assembly 64 comprises a hydraulic actuation assembly having a hydraulic piston assembly 76 coupled to a hydraulic control line 70. Pressurized hydraulic fluid can be selectively applied via control line 70 to shift hydraulic piston assembly 76 along wellbore tubular 54. The hydraulic piston assembly 76 is operatively connected to both isolation assembly 68 and stored energy assembly 66. For example, hydraulic piston assembly 76 may be positioned to act against a shoulder 78 of a tubular isolation assembly 68 in a first direction, and stored energy assembly 66 may be positioned to act against an opposing shoulder 80 of tubular isolation assembly 68 in an opposing direction, as further illustrated in FIG. 4. In this embodiment, isolation assembly 68 comprises tubular member 72, and stored energy assembly 66 is in the form of a coil spring 82 disposed over tubular member 72 and between tubular member 72 and the surrounding wellbore tubular 54.

When an appropriate hydraulic input is provided to actuation assembly 64, the hydraulic piston assembly 76 is shifted or moved along wellbore tubular 54. The movement of hydraulic piston assembly 76 forces tubular member 72 of isolation assembly 68 to slide along wellbore tubular 54 compressing coil spring 82. The continued movement of isolation assembly 68 forces tubular member 72 through flapper elements 58, as illustrated in FIG. 5. Movement of tubular member 72 effectively forces flow restriction assembly 56 and flapper elements 58 to an open configuration in which fluid can freely flow along the fluid flow path, as represented by arrow 84. In the embodiment illustrated, tubular member 72 encloses flapper elements 58 in a cavity 86 formed between tubular member 72 and wellbore tubular 54. The enclosed flapper elements 58 are completely isolated from the flow of fluid through flow control device 47 (see FIG. 1) and flow reduction mechanism 48. In fact, tubular member 72 of the isolation assembly 68 can be positioned to abut a corresponding step 88 of tubular member 54 to create a smooth transition 90 that does not obstruct fluid flow along fluid flow path 62. In at least some applications, tubular member 72 and the input, e.g. hydraulic input, used to shift tubular member 72 can be used to actuate both flow reduction mechanism 48 and flow control device 47 to a desired operational configuration.

Stored energy assembly 66, in the form of coil spring 82, maintains a biasing force against isolation assembly 68 while the flow reduction mechanism 48 is maintained in its open configuration illustrated in FIG. 5. Upon further actuation of assembly 64, e.g. upon release of hydraulic pressure acting on hydraulic piston assembly 76, the stored energy assembly 66 is allowed to move isolation assembly 68 back to its previous position in which flapper elements 5 8 are able to pivot to the closed, flow restricting configuration.

Modifications in the various assemblies of flow control system 46 (see FIG. 1) can be adopted according to overall system design requirements and environmental factors. For example, individual or multiple flapper elements 58 can be utilized in a variety of shapes and sizes, and the flapper elements can be deployed at single or multiple locations along the wellbore tubular. Additionally, the stored energy systems and isolation systems can be changed according to the overall design of the flow control system 46, completion 32, and/or well system 30. Furthermore, control signals can be supplied to actuation assembly 64 from a surface location or from a variety of other locations at or away from the well site. The control signals can be carried by a variety of wired or wireless control lines as required by the actuator assembly to enable selective shifting of the flow reduction mechanism 48 and flow control device 47 (see FIG. 1) from one configuration to another.

Figure 6:
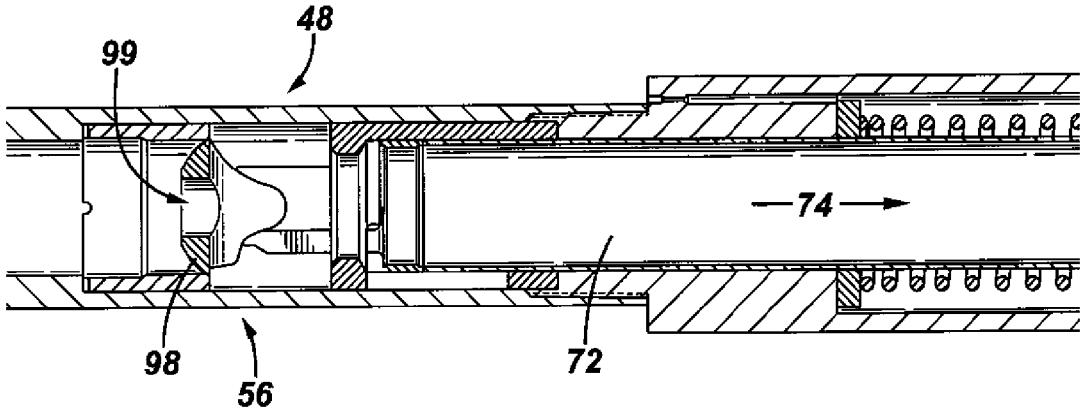
FIG. 6 is a cross-sectional view of another example of a flow reduction mechanism while in a closed configuration, according to an embodiment of the present invention.
Figure 7:
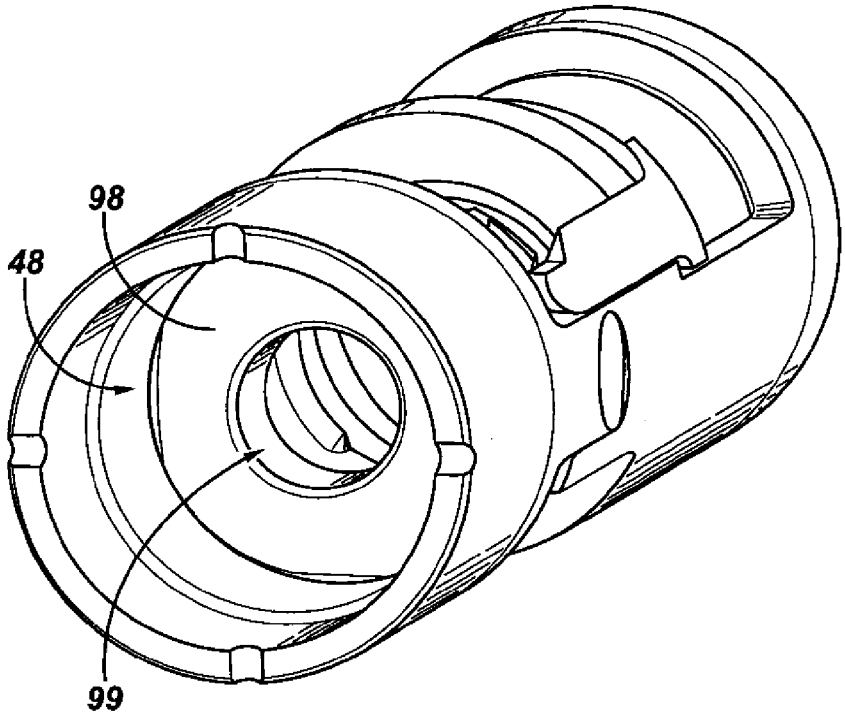
FIG. 7 is a perspective view of the flow reduction mechanism similar to that of FIG. 6 while in a closed configuration, according to another embodiment of the present invention.

Another specific example of a flow reduction mechanism 48 is illustrated in FIGS. 6-7. In this embodiment, flow reduction mechanism 48 comprises a ball valve element 98 that forms an opening 99 when closed. When fluid is flowed through flow restriction assembly 56 comprising the ball valve element 98 in the direction of arrows 74, fluid flow is reduced/restricted by the opening 99 to facilitate actuation of flow control device 47 (see FIG. 1). However, when the ball valve element 98 is pivoted to an open configuration (not shown), the flow restriction assembly 56 is configured to enable full bore flow of fluid. It should be noted that the flow reduction mechanism 48 can be designed and actuated in a variety of configurations.

Referring generally back to FIG. 1, various features and components can be integrated into or used in conjunction with the flow control system 46. For example, the flow control device can incorporate internal self-equalizing components to equalize pressures above and below barrier element 49. The flow control device 47 also may comprise an internal profile with sealing capability to enable acceptance of through-tubing accessories, such as plugs, flow measurement tools, lock mandrels, and other accessories. In some embodiments, the flow control system 46 may incorporate a locking mechanism that can be actuated to either temporarily or permanently lock the flow control system in an open state to facilitate removal of components, installation of components, and other service operations.

Other examples of components that can be used with the flow control system include dynamic or static mechanisms positioned to prevent debris from entering portions of the flow control device 47 or flow reduction mechanism 48 that would interfere with the function of their respective closure members. In some applications, the flow control system 46 may be constructed with a body having an eccentric design to optimize the inside diameter to outside diameter relationship. A variety of chemical injection systems also can be incorporated with the flow control system to enable selective injection of chemicals during service operations or other downhole operations. The flow control device 47 and/or flow reduction mechanism 48 can further incorporate mechanisms that enable selective mechanical actuation of the system if necessary.

Figure 8A:
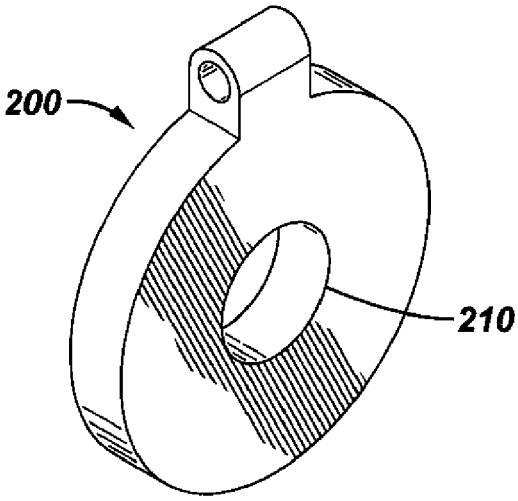
FIGS. 8A and 8B are perspective views of a single and multiple orifice flapper valve according to another embodiment of a component of the present invention.
Figure 8B:
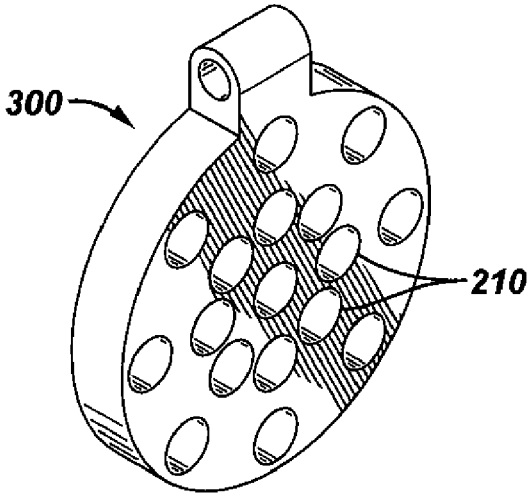

Referring now to FIGS. 8A-8B, another embodiment of a component used with a flow control system may include a flapper valve with a flapper mechanism containing an orifice. In FIG. 8A, a flapper mechanism 200 may contain a single orifice 210 or in some cases, as shown in FIG. 8B, a flapper mechanism 300 may contain multiple orifices 210. Although a circular orifice 210 is shown in both figures, embodiments of the present invention may not be limited to any particular geometry. Also, only the flapper mechanism 200, 300 is shown in these figures. A person of skill in the art would recognize other components (not shown) such as, for example, a spring to bias the flapper mechanisms 200, 300 in a closing direction, a tube or other device to open the flapper mechanism 200, 300, and a valve seat for abutting against the flapper mechanism 200, 300 when closed. In some embodiments, a series of flapper valves may be used in an incremental fashion prior to actuation of the flow control device 47.

Figure 9:
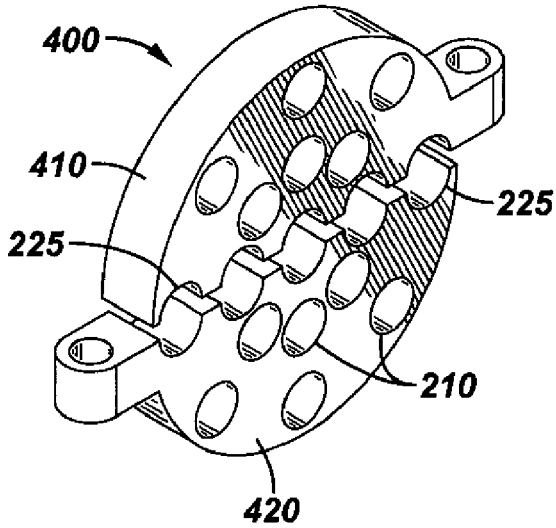
FIG. 9 is a perspective view of a dual element flapper valve according to another embodiment of a component of the present invention.

Yet another exemplary embodiment of a component used in a flow control system is illustrated in FIG. 9. In this embodiment, a flapper valve 400 comprising a first flapper mechanism 410 and a second flapper mechanism 420 may be used. The first and second flapper mechanisms 410, 420 may contain one or more orifices 210 similar to flapper valves 200, 300. In addition or alternatively, the first and second flapper mechanisms 410, 420 may close to form orifices. As shown, the first flapper mechanism 410 may contain a semi-circular groove 225 and the second flapper mechanism 420 may contain a corresponding semi-circular groove 225. When the first and second flapper mechanisms 410, 420 are actuated, the corresponding semi-circular grooves 225 may form an orifice configured to reduce the flow of a fluid through a well bore. Although identical grooves 225 are shown in the first and second flapper mechanisms 410, 420, this is only to simplify the detailed description and not to limit the range and location of flow reducing devices. As with the flapper mechanisms 200 and 300, other components used to implement the flapper valve are not shown but are within the knowledge of a person of skill in the art.

In some embodiments, activation, positions of the flow control device 47 and/or the flow reduction mechanism 48, and operation may be measured and/or monitored using sensor technology. The sensor technology may be provided within the flow control device 47 and/or the flow reduction mechanism 48 to measure the well fluid flows, temperatures, pressures, and stresses within the system, among other parameters. The sensor technology may be used to identify the location of the flow control device 47 and the flow reduction mechanism 48 within multiple zones of a multi-zone formation.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims. Additionally, the use of the word closed or opened should be interpreted with their broadest meanings. For example, closed or a derivative of closed should include but not be limited in interpretation to mean actuated, shifted, etc., while opened or a derivative of open should likewise include unrestricted, un actuated, etc.

What is claimed is:

1. A method for use in a wellbore that provides a reduction of a flow and a corresponding reduction of flow induced forces on one or more related primary flow controlling members comprising:

providing a flow reduction device in a well equipment string;

positioning the flow reduction device on an uphole side of a related primary flow controlling member;

actuating the flow reduction device to limit an uphole flow to a restricted uphole flow prior to or in conjunction with closure of the related primary flow controlling member; and actuating the related primary flow controlling member.

2. The method of claim 1 wherein the flow reduction device is coupled with the related primary flow controlling member.

3. The method as recited in claim 1 wherein the related primary flow controlling member is a subsurface safety valve.

4. The method as recited in claim 1 wherein the related primary flow controlling member is a formation isolation valve.

5. The method as recited in claim 1 wherein the related primary flow controlling member is an injection valve.

6. The method as recited in claim 1 wherein the related primary flow controlling member is an on/off or multiple position downhole production/injection flow control valve.

7. The method as recited in claim 1 wherein the related primary flow controlling member comprises one or more flapper closure mechanisms.

8. The method as recited in claim 1 wherein the related primary flow controlling member comprises at least one of one or more sleeve closure mechanisms.

9. The method as recited in claim 1 wherein the flow reduction device comprises one or more flapper mechanisms.

10. The method as recited in claim 1 wherein the flow reduction device comprises at least one sleeve closure mechanism.

11. A system for use in a well, comprising:

a flow reduction mechanism which is positionable in a flow path routed through a primary flow control device of a well equipment string, the flow reduction mechanism comprising a plurality of flapper elements, each flapper element being pivotably mounted at a position which enables the plurality of flapper elements to pivot into engagement with each other to form a restricted flow opening sized to reduce a flow of a fluid in the well.

12. The system of claim 11 wherein the primary flow control device is a flapper valve.

13. The system of claim 11 wherein the flow reduction mechanism is downstream of the primary flow control device when fluid is flowing uphole.

14. The system of claim 11 wherein the flow reduction mechanism and the primary flow control device are independently actuated.

15. A method of controlling fluid flow in a wellbore, comprising:

constructing a flow reduction mechanism with a plurality of flapper elements, each flapper element being pivotably mounted at a position which enables the plurality of flapper elements to pivot into engagement with each other to form a restricted flow opening sized to reduce a flow of a fluid therethrough; and providing the flow reduction mechanism with an independent actuation assembly which may be selectively actuated to force the plurality of flapper elements to an open flow position for open flow of fluid along the fluid flow path or to a position which allows the flapper elements to pivot and form the restricted flow opening.

16. The method as recited in claim 15 further comprising actuating the actuation assembly to allow the flapper elements to pivot and form the restricted flow opening prior to or in conjunction with actuation of a flow control device positioned upstream of the flow reduction mechanism.

* * * * *